US009390658B2

(12) United States Patent
Kang et al.

(10) Patent No.: US 9,390,658 B2
(45) Date of Patent: Jul. 12, 2016

(54) APPARATUS AND METHOD FOR DISPLAYING IMAGE, APPARATUS AND METHOD FOR DRIVING LIGHT EMITTING DEVICE

(71) Applicant: SAMSUNG ELECTRONICS CO., LTD., Suwon-si (KR)

(72) Inventors: Jeong-il Kang, Yongin-si (KR); Gil-Yong Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 112 days.

(21) Appl. No.: 13/914,844

(22) Filed: Jun. 11, 2013

(65) Prior Publication Data

US 2013/0328949 A1 Dec. 12, 2013

(30) Foreign Application Priority Data

Jun. 11, 2012 (KR) ..... 10-2012-0062254

(51) Int. Cl.
*G09G 3/36* (2006.01)
*G09G 3/34* (2006.01)

(52) U.S. Cl.
CPC ..... *G09G 3/3406* (2013.01); *G09G 2320/062* (2013.01); *G09G 2320/064* (2013.01); *G09G 2360/16* (2013.01)

(58) Field of Classification Search
CPC ..... G09G 2320/062; G09G 2320/064; G09G 2360/16; G09G 3/3406
USPC ..... 345/102
See application file for complete search history.

(56) References Cited

U.S. PATENT DOCUMENTS

| | | | | |
|---|---|---|---|---|
| 2008/0203929 | A1* | 8/2008 | Park et al. | 315/158 |
| 2008/0248837 | A1 | 10/2008 | Kunkel | |
| 2009/0243994 | A1* | 10/2009 | Hatano et al. | 345/102 |
| 2010/0060671 | A1* | 3/2010 | Park et al. | 345/690 |
| 2010/0141155 | A1* | 6/2010 | Hong et al. | 315/152 |
| 2010/0164922 | A1 | 7/2010 | Nose et al. | |
| 2011/0084980 | A1 | 4/2011 | Lee | |
| 2011/0134023 | A1 | 6/2011 | Feng | |
| 2012/0104956 | A1 | 5/2012 | Yang et al. | |
| 2012/0105515 | A1* | 5/2012 | Iwasaki | G09G 3/3406 345/691 |

OTHER PUBLICATIONS

Communication, dated Sep. 24, 2013, issued by the European Patent Office, in counterpart Application No. 13171010.5.
Communication issued on Apr. 8, 2015 by the European Patent Office in related Application No. 13171010.5.

* cited by examiner

*Primary Examiner* — Long D Pham
(74) *Attorney, Agent, or Firm* — Sughrue Mion, PLLC

(57) ABSTRACT

An apparatus and a method for displaying an image, and an apparatus and a method for driving a light emitting device are provided. The light emitting device of the image display is controlled in accordance with a periodic signal relating to the image and a sensing signal reflecting an operating state of the light emitting device.

27 Claims, 6 Drawing Sheets

APPARATUS AND METHOD FOR DISPLAYING IMAGE, APPARATUS AND METHOD FOR DRIVING LIGHT EMITTING DEVICE

CROSS-REFERENCE TO RELATED APPLICATIONS

This application claims benefit under 35 U.S.C. §119 (a) from Korean Patent Application No. 2012-0062254, Jun. 11, 2012 filed on in the Korean Intellectual Property Office, the entire disclosure of which is incorporated herein by reference.

BACKGROUND

1. Field

The present disclosure relates generally to an apparatus and a method for displaying an image, and an apparatus and a method for driving a light emitting device. More particularly, the present disclosure relates to such an apparatus and method which saves manufacturing costs and reduces generation of heat when the light emitting device is used in an image displaying apparatus, for example, as an LED backlight.

2. Description of the Related Art

In general, an image display device used to display an image signal input from a video card can be classified into a light emitting type and a light receiving type. For example, an image display device such as a CRT or PDP is a light emitting type and displays an image by emitting the light by itself, whereas an LCD selectively generates contrast and displays the image by injecting a liquid crystal between two thin glass substrates and changing arrangement of liquid crystal molecules when power is supplied. Since, an LCD is of the light receiving type, it cannot operate without a rear light source. Accordingly, a surface light source backlight lamp is required to maintain uniform brightness throughout the screen.

The backlight lamp can be implemented, for example, by a plurality of LEDs disposed around edges of a panel or over a rear side of the panel in order to provide light as the surface light source. Typically, the type placed around the edges is referred to as an edge type, and the type placed over the rear side is referred to as a direct type.

The image display device includes a lamp driver for driving the backlight lamp. The lamp driver can include a power circuit for switching the backlight lamp on and off.

However, LED devices forming the backlight lamp are sensitive to temperature. To accommodate the heat generated inside the LED device and the driver, various conventional methods relating to the lamp driver are known. For example, one conventional technique configures an LED driving circuit on the secondary side of a transformer and controls the heat by sensing the temperature through a temperature sensor. Such a technique is subject to low accuracy and suffers from a high rate of defective products relating to the assembly of the sensor.

SUMMARY

An aspect of the present disclosure addresses the above-mentioned and/or other problems and disadvantages and an aspect of the present disclosure provides an apparatus and method for displaying an image, and an apparatus and method for driving a light emitting device, for reducing the heat problem associated with driving such LED devices, and for reducing the cost of manufacturing a circuit for reducing the heat problem.

According to an aspect of the present disclosure, an apparatus for displaying an image includes a periodic signal providing unit for generating and outputting image data of an input image and a timing signal for displaying the image data on a screen, and also providing a periodic signal relating to the image; a display panel for receiving the image data and the timing signal, and displaying an image on the screen using the image data and the timing signal; and a backlight subsystem for generating a control signal to control a light emitting device which provides light to the display panel, and the backlight subsystem controlling the light emitting device by changing the control signal using the periodic signal provided from the periodic signal providing unit and a sensing signal which senses an operation of the light emitting device.

The periodic signal may comprise a dimming signal indicating brightness of the image.

The backlight subsystem may control the light emitting device by changing the control signal according to a product of the periodic signal value and the sensing signal value.

An apparatus for driving a light emitting device includes a detector for receiving a periodic signal relating to an image input to an image displaying apparatus, and for detecting and outputting a detection signal derived from the received periodic signal; an operation limiter for outputting different result values according to the size of a sensing signal which senses a light emitting device which provides light to the image displaying apparatus; and a signal regulator for generating a control signal used to control the light emitting device, and the signal regulator changing and outputting the control signal based on the detection signal and the result value.

The apparatus may further include an operator for providing the signal regulator with a product of the detection signal value and the result value, the product to be used to change the control signal.

When an ON interval of the periodic signal exceeds a limit value corresponding to the product of the detection signal value and the result value, the signal regulator may adjust the periodic signal to have a low state during the ON time period of the periodic signal exceeding the limit value.

The apparatus may further include a switch responsive to the adjusted control signal to provide the sensing signal to the operation limiter.

The apparatus may further include a controller for controlling the light emitting device using the adjusted control signal of the signal regulator.

The detector may detect a period by detecting an edge of the periodic signal, and output a period value of the detected period as the detection signal.

The operation limiter may include a lookup table (LUT) which outputs a different result value according to the size of the result value.

The operation limiter may include a comparator for comparing the sensing signal value with a preset value and outputting a comparison result; and storage for storing result values matched to comparison results, and outputting a different result value according to the comparison result of the comparator.

A method for displaying an image includes generating and outputting image data of an input image and a timing signal for displaying the image data on a screen, and providing a periodic signal relating to the image; receiving the image data and the timing signal, and displaying an image on the screen of a display panel using the image data and the timing signal; generating a control signal to control a light emitting device which provides light to the display panel; and controlling the light emitting device by adjusting the control signal using the periodic signal and a sensing signal which senses an operation of the light emitting device.

The periodic signal may comprise a dimming signal indicating brightness of the image.

The controlling of the light emitting device may control the light emitting device by changing the control signal according to a product of a signal value of the periodic signal and a signal value of the sensing signal.

A method for driving a light emitting device includes receiving a periodic signal relating to an image input to an image displaying apparatus, and detecting and outputting a signal value from the received periodic signal; outputting a result value according to a signal value size of a sensing signal which senses light emitting device which provides light to the image displaying apparatus; generating a control signal used to control the light emitting device, and changing and outputting the control signal using the detected signal value and the result value.

The changing and outputting of the control signal may change the control signal using a product of the detected signal value and the result value.

When on the ON interval (Ton) of the periodic signal exceeds a limit value of the product of the signal value and the result value, the changing and outputting of the control signal may change the periodic signal to maintain it in a low state during a time interval having a duration corresponding to a portion of the turn-on interval exceeding the limit value.

The method may further include receiving the sensing signal under control of the changed control signal to output the sensing signal to be used to output the result value.

The method may further include controlling the light emitting device using the changed control signal.

The detecting and outputting of the signal value from the received periodic signal may detect a period by detecting an edge of the periodic signal, and output a period value of the detected period as the signal value.

The outputting of the different result value may comprise outputting a result value stored in a lookup table LUT according to the signal value size.

The outputting of the different result value may include comparing a signal value size of the sensing signal with a preset value and outputting a comparison result; storing result values matched to comparison results, and outputting a different result value according to the comparison result of the comparator.

BRIEF DESCRIPTION OF THE DRAWING FIGURES

These and/or other aspects and advantages of the present disclosure will become apparent and be more readily appreciated from the following description of the embodiments, taken in conjunction with the accompanying drawings, of which:

DETAILED DESCRIPTION OF THE EXEMPLARY EMBODIMENTS

Figure 1:
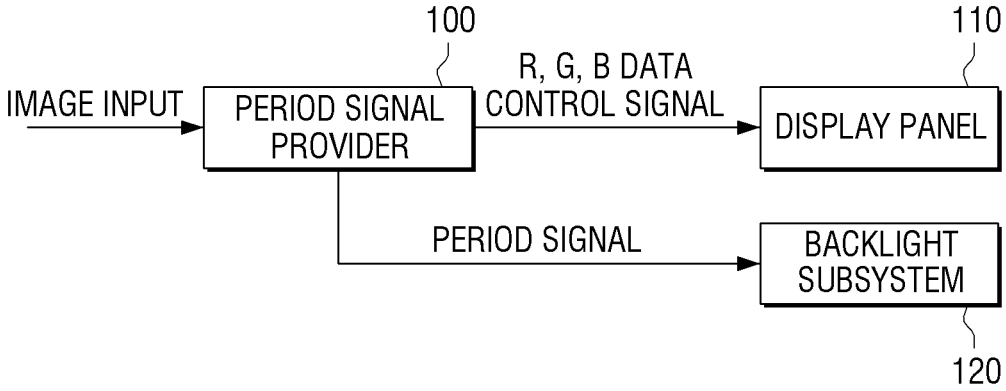
FIG. 1 is a block diagram of an image displaying apparatus according to one exemplary embodiment.

Reference will now be made in detail to exemplary embodiments of the present disclosure, examples of which are illustrated in the accompanying drawings, wherein like reference numerals refer to the like elements throughout. The embodiments are described below to explain the present disclosure by referring to the figures.

FIG. 1 is a block diagram of an image displaying apparatus according to one embodiment of the present disclosure.

As shown in FIG. 1, the image displaying apparatus according to one exemplary embodiment of the present disclosure includes part or all of a periodic signal providing unit 100, a display panel 110, and a backlight subsystem 120. Herein, part or all implies that, for example, the periodic signal providing unit 100 may be integrated into the backlight subsystem 120. For ease of understanding, all of them are separately illustrated.

The periodic signal providing unit 100 accepts R, G and B image data as input from an external source and outputs it in accordance with a resolution of the image displaying apparatus. For example, the periodic signal providing unit 100 converts 8-bit R, G, and B video data to 6-bit data and provides the 6-bit data to the display panel 110. The periodic signal providing unit 100 can also generate, for example, a timing signal for controlling the timing of a gate/source driver in the display panel 110.

While specific signals are not shown in FIG. 1, the periodic signal providing unit 100 can generate control signals such as clock signal DCLK, and vertical and horizontal synchronization signals Vsync and Hsync, suitable for the resolution of the image displaying apparatus, and provide them to the backlight subsystem 120. The backlight subsystem 120 can then turn on and off a backlight including a light emitting device in synchronization with the input image.

The periodic signal providing unit 100 also provides a periodic signal to the backlight subsystem 120, e.g., a dimming signal DIMMING can be generated from the input image periodic signal. Herein, the dimming signal is a signal indicating brightness information of a unit frame of the input image, and indicates darkness of the corresponding unit frame. However, the periodic signal is not limited to a dimming signal in embodiments of the present disclosure. The periodic signal may use the vertical/horizontal synchronization signal Vsync/Hsync and the timing signal, and a new periodic signal may be generated and output using the vertical/horizontal synchronization signal and the timing signal.

As is known, the display panel 110 can include, for example, a liquid crystal layer interposed between the first and second substrates, with the first substrate forming a plurality of gate lines GL1 through GLn and data lines DL1 through DLn crossed to define pixel regions, and a pixel electrode formed in the crossed pixel region. A Thin Film Transistor (TFT) is formed in one region, more particularly, at a corner of the pixel regions. When the TFT is turned on, the liquid crystal is twisted by a difference of the voltages applied to the pixel electrode of the first substrate and a common electrode of, for example, the second substrate, to pass the light provided from the backlight subsystem 120.

The display panel 110 can include a gate driver and source driver formed on the exterior of a display unit. In this case, the display panel 110 operates the gate driver and the source driver according to the timing signal provided from the periodic signal providing unit 100, and represents the R, G and B data provided from the periodic signal providing unit 100 in the display unit through the source driver, to present the image, which will be explained in detail.

The backlight subsystem 120 can be divided into a lamp driver for processing the periodic signal provided from the periodic signal providing unit 100, and a backlight lamp for providing the backlight under control of the lamp driver. Herein, the backlight lamp includes light emitting devices, for example, LEDs, and provides the backlight to the display panel 110 according to directions of the lamp driver. The lamp driver drives the backlight lamp by changing the periodic signal provided from the periodic signal providing unit 100, and controls feedback of the backlight lamp. In this way, the backlight subsystem 120 variably generates and outputs a control signal for controlling the light emitting device using, for example, the periodic signal, and controls the light emitting device using the varied control signal.

According to one embodiment of the present, upon receiving the periodic signal from the periodic signal providing unit 100, the backlight subsystem 120 adjusts, for example, a pulse width of the periodic signal using the received periodic signal and a sensing signal of the light emitting device, and controls the light emitting device based on the adjusted periodic signal. As a result, the heat of the light emitting device can be efficiently controlled. In more detail, when the light emitting device operates within a normal range, the backlight subsystem 120 operates the light emitting device according to the input periodic signal without adjusting the pulse width. Out of the normal range, the backlight subsystem 120 controls the light emitting device by linearly changing the pulse width of the periodic signal in proportion to the size of the difference value. For example, provided that the light emitting device normally operates with 10V, the light emitting device will be normally operated without modulating the pulse width when the light emitting device is operating at about 10V. When the light emitting device is operating at something above 10V, the light emitting device is operated by linearly reducing the pulse width in proportion to the increase. Herein, the linearity can signify a plurality of processes for determining whether the light emitting device normally operates on a certain time cycle. A soft starter, a comparator, or a lookup table can be used to have the adjustment rate of the pulse width, for example, linearly varying characteristics, to be explained detail.

Figure 2:
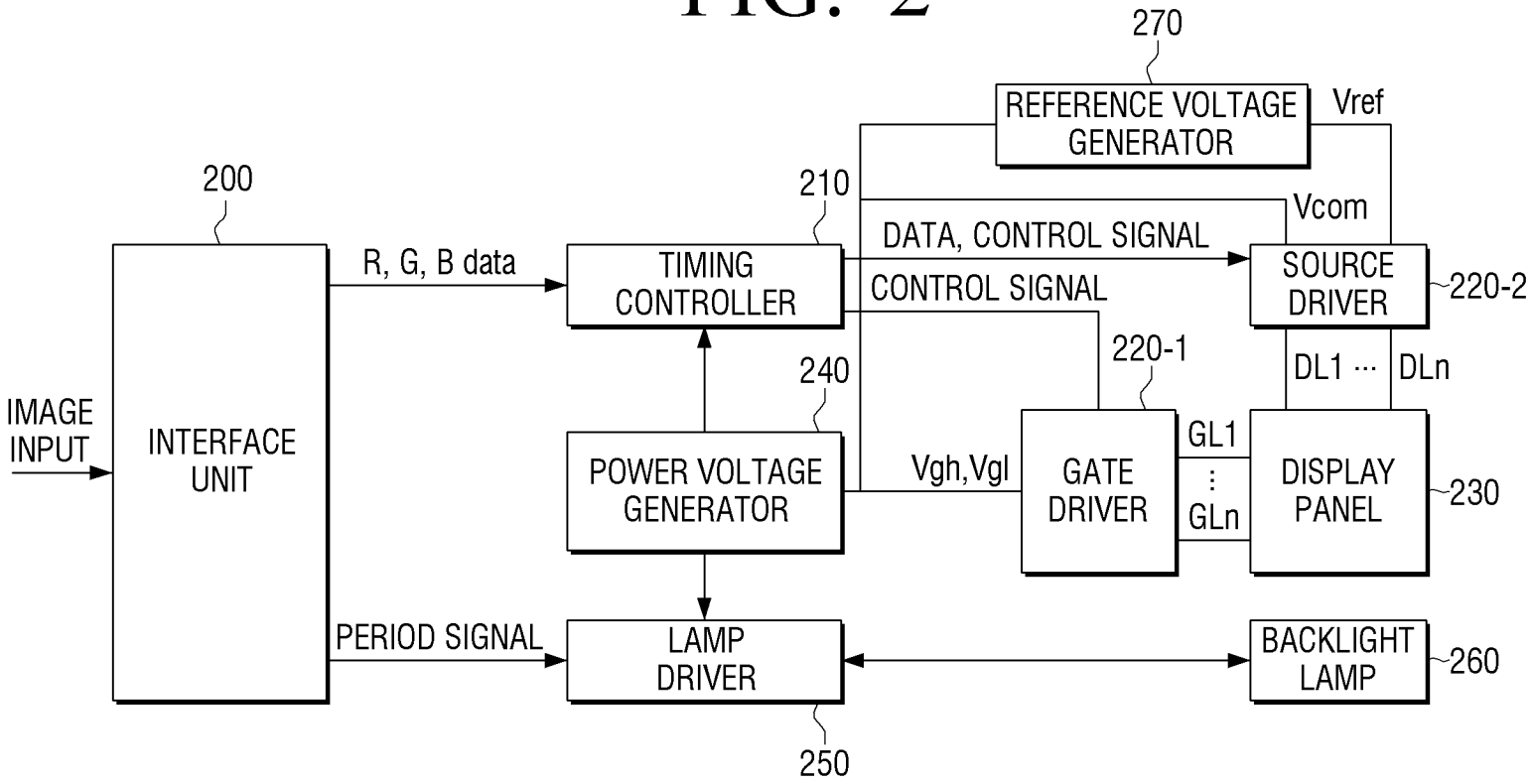
FIG. 2 is a block diagram of the image displaying apparatus according to another exemplary embodiment.

FIG. 2 is a block diagram of the image displaying apparatus according to another embodiment of the present disclosure.

As shown in FIG. 2, the image displaying apparatus according to another embodiment of the present disclosure includes part or all of an interface unit 200, a timing controller 210, gate and source drivers 220-1 and 220-2, a display panel 230, a power voltage generating unit 240, a lamp driver 250, a backlight lamp 260, and a reference voltage generating unit 270. Some of the components can be integrated, for example, the lamp driver 250 and the backlight lamp 260 can be integrated into the backlight subsystem. To ease understanding, all of them are separately shown.

The interface unit 200, which is an image board such as graphic card, converts and outputs image data input from the outside in accordance with the resolution of the image displaying apparatus. Herein, the image data can be 8-bit R, G and B image data. The interface unit 200 can generate control signals such as clock signal DCLK, and vertical and horizontal synchronization signals Vsync and Hsync, suitable for the resolution of the image displaying apparatus. The interface unit 200 provides the image data to the timing controller 210 and provides the vertical/horizontal synchronization signal to the lamp driver 250. Thus, when the display panel 230 presents the image, the backlight lamp 260 is turned on and off according to the synchronization.

The interface unit 200 can include an image analyzer (not shown) or a periodic signal generator (not shown). Herein, the image analyzer can determine the brightness by analyzing the input image. The interface unit 200 can generate a dimming signal in accordance with the determined brightness, for example, the dimming signal can indicate darkness for consecutive unit frames, and can provide the dimming signal to the lamp driver 250 as the periodic signal. While it is preferred that the image analyzer is included in the interface unit 200, the image analyzer may instead be separately provided. Also, the interface unit 200 may provide the vertical/horizontal synchronization signal as the periodic signal, rather than the dimming signal, and generate and provide to the lamp driver 250 a new periodic signal using the vertical/horizontal synchronization signal.

The timing controller 210 provides the image data of the interface unit 200 or the image analyzer to the source driver 220-2 and controls the image data output of the source driver 220-2 using the timing signal so that the display panel 230 can sequentially present the unit frame image. The timing controller 210 controls the gate driver 220-1 to forward the gate on/off voltage provided from the power voltage generating unit 240 to the display panel 230 on a horizontal line basis. For example, when the gate voltage is applied to the first gate line GL1, the timing controller 210 controls the source driver 220-2 to apply the image data corresponding to the first horizontal line. The timing controller 210 turns on the second gate line GL2 and concurrently turns off the first gate line so that the image data corresponding to the second horizontal line is applied from the source driver 220-2 to the display panel 230. Thus, the unit frame image is displayed all over the screen of the display panel 230.

Meanwhile, the timing controller 210 can provide the lamp driver 250 with the timing signal as the periodic signal and control the lamp driver 250 to generate the periodic signal using the timing signal, which is not shown in the drawing. Alternatively, the timing controller 210 may directly generate and provide a new periodic signal to the lamp driver 250 using the timing signal. For example, the periodic signal can be generated and output using the gate signal indicating the display time of the unit frame image. As such, the periodic signal can use various signals and is not limited to a particular one. Accordingly, either the interface unit 200 or the timing controller 210, or a combination of the two, can include a periodic signal generator for generating the periodic signal therein.

The gate driver 220-1 receives the gate on/off voltage Vgh/Vgl from the power voltage generating unit 240 and applies the corresponding voltage to the display panel 230 under the control of the timing controller 210. When the display panel 230 displays the image, the gate "on" voltage Vgh is provided from the first gate line GL1 to the N-th gate line GLn in order.

The source driver 220-2 converts the serial image data provided from the timing controller 210 to parallel image data and converts the digital data to an analog voltage to thus provide the image data corresponding to one horizontal line to the display panel 230 all together in sequence. The source driver 220-2 can receive a common voltage Vcom generated by the power voltage generating unit 240 and a reference voltage (or a gamma voltage) Vref from the reference voltage generating unit 270. Herein, the common voltage Vcom is provided to a common electrode of the display panel 230, and the reference voltage Vref is provided to a D/A converter of the source driver 220-2 and used to represent the gray scale of the color image. In other words, the image data provided from the timing controller 210 can be provided to the D/A converter. Digital information of the video data provided to the D/A converter is converted to the analog voltage to represent the gray scale of the color and then provided to the display panel 230.

The display panel 230 has been fully explained above in the context of the display panel 110 according to one embodiment of the present disclosure and thus shall not be further described. Yet, when the display panel 230 is implemented as the self-luminous display panel 230 including an OLED, it is understood that the display panel 230 includes the backlight lamp 260.

The power voltage generating unit 240 receives the mains voltage, that is, the AC voltage 110V or 220V from the outside, and generates and outputs DC voltage of various levels. For example, the power voltage generating unit 240 can generate and provide the voltage of DC 15V as the gate on voltage Vgh for the gate driver 220-1, generate and provide the voltage of DC 24V as the power voltage Vcc for the lamp driver 250, and generate and provide the voltage of DC 12V for the timing controller 210.

The lamp driver 250 converts the voltage provided from the power voltage generating unit 240 and provides the converted voltage to the backlight lamp 260. Herein, the conversion converts the analog DC level to another level or to a Pulse Width Modulation (PWM) drive signal. The lamp driver 250 can concurrently or sequentially drive the R, G and B LEDs of the backlight lamp 260. Further, the lamp driver 250 can include a feedback circuit for controlling the feedback of the LED driving current so that the RGB LEDs of the backlight lamp 260 can provide uniform light. The feedback circuit may be referred to as a switching power circuit. The feedback circuit will be explained in detail below.

According to another embodiment of the present disclosure, the lamp driver 250 can receive the periodic signal from the interface unit 200 or from the timing controller 210, and controls the light emitting devices of the backlight lamp 260 using the received periodic signal. For example, the light emitting devices of the backlight lamp 260 can be PWM-controlled by the lamp driver 250. The lamp driver 250 controls the light emitting devices differently according to whether the sensing voltages of the light emitting devices are out of a normal range. For example, when the sensing voltage is not out of the normal range, the lamp driver 250 controls the light emitting device without adjusting the pulse width of the received periodic signal. When the sensing voltage is out of the normal range, the lamp driver 250 controls the light emitting device by linearly decreasing the pulse width in proportion to the change.

In doing so, for example, the lamp driver 250 can extract a signal value by detecting the periodic signal provided from the interface unit 200 or the timing controller 210, generate a result value of a comparison by comparing the sensing voltage of the light emitting device with a preset value, output a product of the extracted signal value and the generated result value using, for example, a multiplier, change the pulse width of the periodic signal based on the product, and thus control the light emitting device. For example, the lamp driver 250 can PWM-control the light emitting device by generating and outputting a new counting signal which counts an external clock signal according to the product in synchronization with a rising edge of the periodic signal. It should be noted that the multiplier may be implemented using a combinational logic circuit, and the embodiment of the present disclosure is not limited to the use of a multiplier.

The backlight lamp 260 includes, for example, the RGB LEDs. For example, the backlight lamp 260 can be formed in any type such as direct type which arranges the RGB LEDs over the lower end of the display panel 230 or edge type which arranges the RGB LEDs around the edges of the display panel 230. Yet, the backlight lamp 260 can turn on or off the light emitting devices at the same time or separately on a block basis under the control of the lamp driver 250, and control the PWM. The plurality of the LEDs can be connected in series or in parallel.

The reference voltage generating unit 270 can be referred to as a gamma voltage generating unit. When receiving, for example, a DC 10V voltage from the power voltage generating unit 240, the reference voltage generating unit 270 can divide the voltage to multiple voltages using a segment resistor and provide the divided voltages to the source driver 220-2. Thus, the source driver 220-2 subdivides the received voltages to represent 256 gray scale levels of the R, G and B data.

As a result, the image displaying apparatus according to this second embodiment of the present disclosure shown in FIG. 2 can save manufacturing costs and efficiently improve the operating heat of the light emitting device, compared to the conventional structure using a transformer to generate a variable voltage. Herein, the efficiency is largely achieved by the precise control of the light emitting device.

Figure 3:
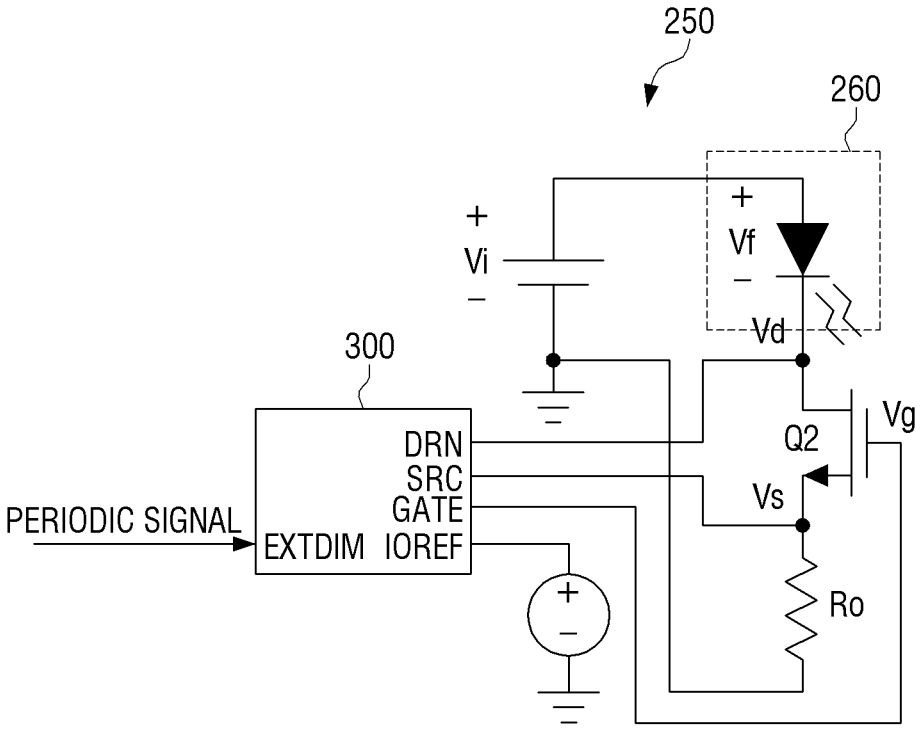
FIG. 3 is a circuit diagram of a lamp driver and a backlight subsystem of FIG. 2.

FIG. 3 is a circuit diagram of one example of the lamp driver and the backlight lamp of FIG. 2.

Referring to FIGS. 3 and 2, the lamp driver 250 according to an embodiment of the present disclosure can include a controller 300 and peripheral circuits around the controller 300. In this example, the peripheral circuit includes a switching element Q2 and a resistor Ro in FIG. 3, and can further include a power source. In this example, the voltage source is shown as a fixed power source Vi and a preset reference power source IOREF.

The controller 300 can form, for example, an integrated circuit (IC) as shown in the drawing, and can include an EXTDIM terminal for receiving the dimming signal as the periodic signal from the outside, a DRN terminal for sensing the sensing voltage of the light emitting device (in this example the end-to-end voltage Vd of the switching element Q2 and the resistor Ro serially connected), an SRC terminal for sensing the voltage Vs of the resistor Ro, an IOREF terminal for receiving the preset reference voltage, and a GATE terminal for controlling the switching element Q2. While the controller 300 in this example is an IC, the embodiment of the present disclosure is not limited to use of an IC for the controller 300.

As constructed above, the controller 300 receives the signal IOREF preset by a user, compares the received preset reference signal and the feedback signal, that is, the signal input to the SRC terminal of the controller 300, and generates and outputs a comparison result to the gate terminal of the switching element Q2 to thus drive the switching element Q2.

At this time, the controller 300 can PWM-control the switching element Q2 by, e.g., providing the comparison result as the PWM control signal. The light emitting device can operate while providing the constant light under the PWM control.

The controller 300 can also generate a control signal of an adjusted pulse width from the periodic signal input to the EXTDIM terminal according to the level of the sensing voltage Vd input to the DRN terminal, and can control the turn-on and turn-off timing of the switching element Q2 using the pulse-width-adjusted control signal. Thus, the input periodic signal can be changed and used, rather than generating and using a new control signal.

A drain terminal of the switching element Q2 is connected to a cathode terminal of the light emitting device and the DRN terminal of the controller 300, a gate terminal is connected to the GATE terminal of the controller 300, and a source terminal is connected to one side of the resistor Ro and the SRC terminal of the controller 300. In this example, the other side of the resistor Ro is grounded.

Figure 4:
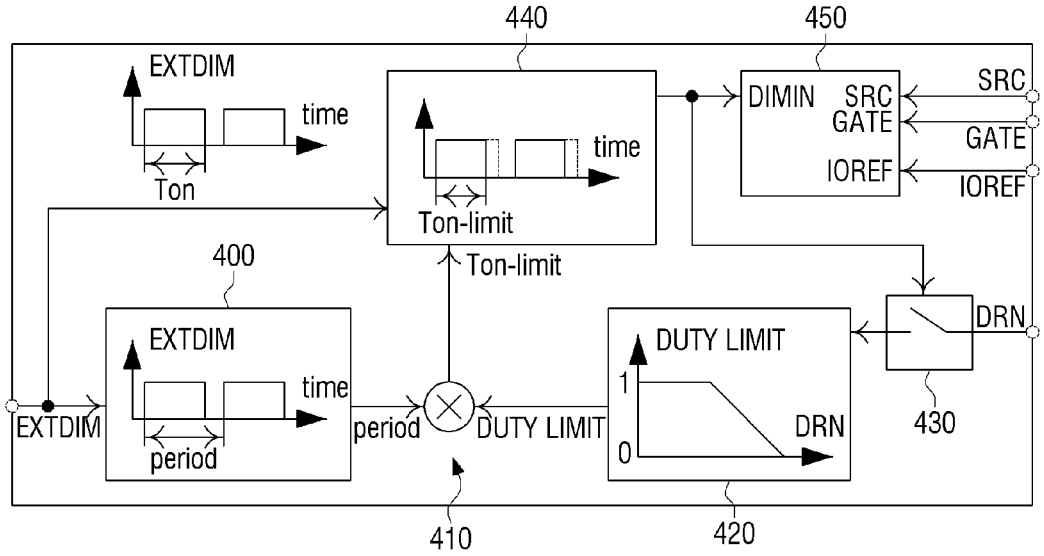
FIG. 4 is a circuit diagram of a controller of FIG. 3.

FIG. 4 is a circuit diagram of one example of the controller of FIG. 3.

As shown in FIG. 4, the controller 300 according to an embodiment of the present disclosure can be referred to as a light emitting device driving apparatus, and can include part or all of a detector 400, an operator 410, an operation limiter 420, a switching unit 430, a signal regulator 440, and a controller 450. The controller need not be implemented exactly as illustrated, e.g., the operator 410 may be included in the signal regulator 440, or the switching unit 430 can be omitted.

The detector 400 can detect the period from the periodic signal input from the outside at EXTDIM, and output a signal having a value representing the detected period. For example, provided that the periodic signal is provided in the form of pulses, the detector 400 determines the period by detecting the rising edge and the falling edge and outputs the period value of the determined period. As such, the period can be detected and the period value of 1 ms can be output according to the detected period.

The operator 410, which is, for example, a multiplier, multiplies the signal value output from the detector 400 by the result value provided from the operation limiter 420 and provides the product to the signal regulator 440. For example, the operator 410 multiplies the value 1 ms, which is the period value provided from the detector 400, by a value of 1 ms or less provided from the operation limiter 420, and provides the product to the signal regulator 440. While the operator 410 may be a multiplier in this embodiment of the present disclosure, a logical circuit including AND or OR gates may be employed.

The operation limiter 420 can include a soft starter for outputting a linear result value from the input value, or a lookup table (LUT) for outputting a preset result value for based on the input value, and can further include a comparator. Hence, the operation limiter 420 determines whether the sensing voltage of the light emitting device provided via the switching unit 430 is out of the normal range, for example, out of a preset voltage range, and outputs a different result value according to the determination. For example, within the normal range, the operation limiter 420 can output the result value "1". Out of the normal range, the operation limiter 420 can output to the operator 410 a result value linearly decreasing from "1" to "0" according to the amount by which the operating voltage is outside of the normal range. As the operation limiter 420 outputs a linearly decreasing result value, the signal regulator 440 can generate the control signal having an adjusted pulse width as, e.g., a PWM control signal and output the generated control signal to the controller 450.

The switching unit 430 is switched on and off by receiving the adjusted pulse width control signal from the signal regulator 440, and accordingly provides the sensing voltage of the light emitting device to the operation limiter 420. In this way, the switching unit 430 is operated by the adjusted pulse width control signal so that the circuit works only when the light emitting device is turned on and thus the voltage which naturally rises when the light emitting device is turned off is not sensed when the light emitting device is turned off.

The signal regulator 440 receives the periodic signal EXTDIM from the outside, and outputs the adjusted pulse width periodic signal as the control signal to the controller 450 based on the operation result value provide from the operator 410. For example, the signal regulator 440 can generate and output the PWM control signal having a low level during a time corresponding to an interval where the received periodic signal is maintained at the high level, if the output of the operator 410 is at a low level. That is, when the product of the operator 410 is the same as the period of the periodic signal EXTDIM input from the outside, the signal regulator 440 outputs the control signal without adjusting the pulse width of the periodic signal. When the product is, for example, 0.8 ms and the period is 1 ms, the signal regulator 440 generates and outputs the control signal where 0.2 ms of the 1 ms Ton interval of the signal EXTDIM is maintained at the low level.

For doing so, the signal regulator 440 can include a trigger (not shown) for detecting the rising edge of the periodic signal EXTDIM input from the outside, and a clock generator and counter for counting the product using the clock and outputting a counting signal. In this way, the counter, which is an N-bit counter, can generate the PWM control signal of adjusted pulse width using a combination of a plurality of flip-flops (FFs) and a logic circuit. In this regard, various methods can be applied and the embodiments of the present disclosure are not limited to particular methods.

The controller 450 can receive the preset signal IOREF from the user, generate the comparison result by comparing it with the feedback signal, that is, the signal input to the SRC terminal of the controller 450, and control the PWM of the light emitting device according to the generated comparison result. The controller 450 receives the adjusted pulse width control signal from the signal regulator 440 according to the level of the sensing voltage of the light emitting device, and PWM-controls the light emitting device according to the received control signal.

Figure 5:
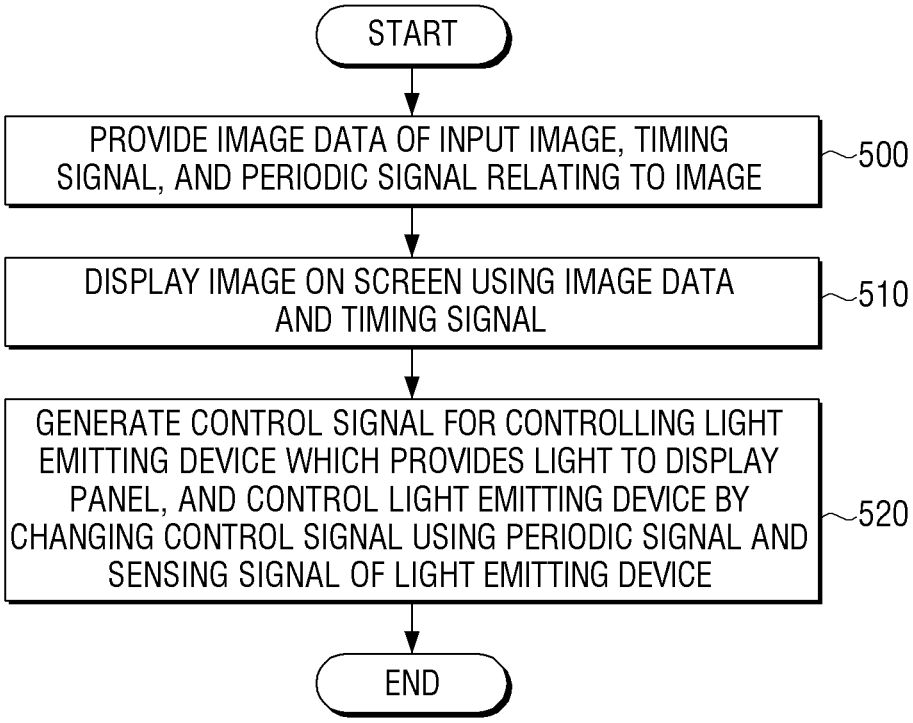
FIG. 5 is a flowchart of an image displaying method according to an exemplary embodiment.

FIG. 5 is a flowchart of an image displaying method according to an embodiment of the present disclosure.

Referring to FIGS. 5 and 1, the image displaying apparatus according to an embodiment of the present disclosure receives the image data of the input image, the timing signal, and the periodic signal relating to the input image (S500). In this example, while the periodic signal is assumed to be provided from the outside, the periodic signal can be generated internally. The periodic signal can be used to control the light emitting device which provides the light to the display panel of the image displaying apparatus.

Next, the image displaying apparatus displays the image on the screen using the image data and the timing signal (S510). In the example described herein, the image can be presented on the screen on the frame basis. To display the image, the image displaying apparatus can be driven at, e.g., 120 Hz or 240 Hz. The image display has been described earlier and shall not be further explained.

The image displaying apparatus generates the control signal for controlling the light emitting device, and controls the light emitting device by adjusting the pulse width of the control signal using the periodic signal and the sensing signal of the light emitting device (S520). For example, the image displaying apparatus provides an output value exhibiting different characteristics according to whether the sensing signal of the light emitting device, e.g., the sensing voltage, is out of the normal range, changes the pulse width of the control signal according to the output value, and controls the light emitting device using the control signal of the adjusted pulse width, which have been described earlier and shall not be further explained. The output value is preferably designed to have linear variation, as discussed above.

Figure 6:
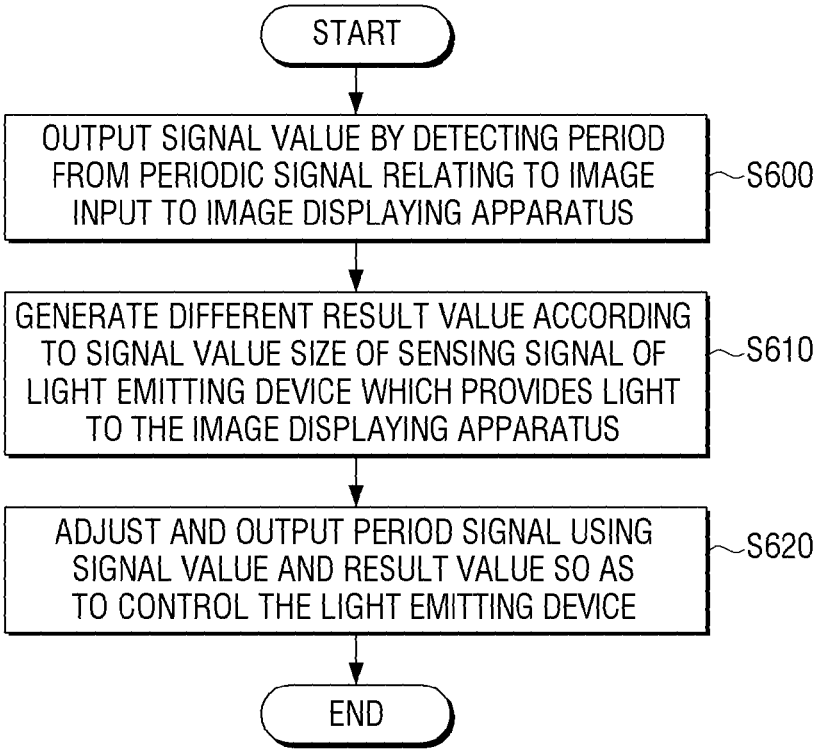
FIG. 6 is a flowchart of a light emitting device driving method according to an exemplary embodiment.

FIG. 6 is a flowchart of a light emitting device driving method according to an embodiment of the present disclosure.

Referring to FIGS. 6, 3 and 4, an apparatus for driving the light emitting device according to this embodiment generates the signal value by detecting the period from the periodic signal relating to the image which is applied to the image displaying apparatus (S600). For example, the apparatus for driving the light emitting device can detect the period by detecting the rising and falling edges of the signal, and output the signal value of lms as the detected period value.

Next, the apparatus for driving the light emitting device generates the different result values according to the signal value size of the sensing signal of the light emitting device which provides the light to the image displaying apparatus (S610). For example, when the signal value size is not out of the normal range, the apparatus for driving the light emitting device outputs the value "1". Out of the normal range, the apparatus for driving the light emitting device outputs a result value linearly decreasing in proportion to the difference. Herein, the different result values can indicate the value "1" and other values smaller than 1.

The apparatus for driving the light emitting device adjusts and outputs the pulse width of the periodic signal using the signal value and the result value so as to control the light emitting device (S620). For example, based on the interval Ton of the input periodic signal, the apparatus for driving the light emitting device adjusts and outputs the pulse width to maintain the low level during a time interval having a duration corresponding to a portion of the Ton interval of the input periodic signal when the product of the periodic signal value and the result value is other than "1". More specifically, when the high interval of the periodic signal is Ton and the product is "1" in the interval 2 Ton/3 and the value other than "1" in other interval 1 Ton/3, the apparatus for driving the light emitting device generates and outputs the control signal with the other interval 1 Ton/3 adjusted to the low level. In so doing, since the apparatus for driving the light emitting device may generate the control signal by adjusting the pulse width of the input periodic signal, the input signal can vary.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An apparatus for displaying an image, comprising:

a display panel configured to display said image on an image screen in response to an image signal; and a backlight subsystem having a light emitting device configured to provide light to the display panel and a backlight control circuit adapted to generate a control signal to control said light emitting device in accordance with a periodic signal related to said image and a sensing signal indicating an operating state of said light emitting device, wherein the backlight subsystem controls the light emitting device according to the periodic signal without adjusting a pulse width of the periodic signal when the light emitting device operates within a normal range, and controls the light emitting device by linearly changing the pulse width of the periodic signal in proportion to a size of the difference value between the normal range and out of the normal range when the light emitting device operates out of the normal range.

2. The apparatus according to claim 1, further comprising a periodic signal provider configured to generate and output image data and a timing signal in response to input image data, and to provide a periodic signal relating to the image, and wherein said backlight control circuit is configured to generate said control signal in response to said periodic signal and said sensing signal.

3. The apparatus of claim 2, wherein the periodic signal comprises a dimming signal indicating brightness of the image.

4. The apparatus of claim 2, wherein the backlight control circuit generates the control signal according to a product of a signal value of the periodic signal and a signal value of the sensing signal.

5. An apparatus for driving a light emitting device of an image display, comprising:

an image signal detector configured to receive a first signal relating to an image input;

an operating state detector configured to receive a second signal relating to an operating state of said light emitting device; and a signal regulator adapted to generate a control signal used to control the light emitting device in response to said first and second signals, wherein the signal regulator generates the control signal without adjusting a pulse width of the periodic signal when the light emitting device operates within a normal range, and generates the control signal by linearly changing a pulse width of the periodic signal in proportion to a size of the difference value between the normal range and out of the normal range when the light emitting device operates out of the normal range.

6. The apparatus according to claim 5, wherein said first signal is a periodic signal.

7. The apparatus according to claim 6, wherein said second signal represents a difference between a desired operating state and a detected operating state of said light emitting device.

8. The apparatus of claim 6, wherein the image signal detector detects a period by detecting an edge of the periodic signal, and outputs a period value of the detected period as a first signal value.

9. The apparatus of claim 5, further comprising:

an operator connected to provide the signal regulator with a product signal corresponding to a product of the signal values of the first and second signals, the product signal to be used to change the control signal.

10. The apparatus of claim 9, wherein the first signal is a periodic signal having a turn-on interval, and when the turn-on interval of the periodic signal exceeds a limit value corresponding to said product signal, the signal regulator changes the periodic signal to maintain the control signal at a low state during a period of time corresponding to a portion of said turn-on interval of said periodic signal that exceeds said limit value.

11. The apparatus of claim 9, further comprising:

a controller adapted to control the light emitting device using the changed control signal.

12. The apparatus of claim 5, further comprising:

a switching unit adapted to provide the second signal to the operating state detector in response to said control signal.

13. The apparatus of claim 5, wherein the operating state detector comprises a lookup table LUT which outputs a different result value according to a size of the second signal.

14. The apparatus of claim 5, wherein the operating state detector comprises:

a comparator adapted to compare a signal value size of the second signal with a preset value and outputting a comparison result; and a storage which stores result values matched to comparison results, and outputs a different result value according to the comparison result of the comparator.

15. A method of displaying an image on a display panel having a backlight subsystem with a light emitting device for providing light to the display panel, said method comprising:

receiving at said display panel an image signal representing said image to be displayed; and controlling said backlight subsystem in accordance with a periodic signal related to said image and in accordance with a sensing signal indicating an operating state of said light emitting device, wherein the controlling the backlight subsystem comprises controlling the light emitting device according to the periodic signal without adjusting a pulse width of the periodic signal when the light emitting device operates within a normal range, and controlling the light emitting device by linearly changing the pulse width of the periodic signal in proportion to a size of the difference value between the normal range and out of the normal range when the light emitting device operates out of the normal range.

16. The method of claim 15, wherein said signal related to said image is a periodic signal.

17. The method of claim 16, wherein the periodic signal comprises a dimming signal indicating brightness of the image.

18. The method of claim 16, wherein the controlling comprises controlling the light emitting device according to a product of a signal value of the periodic signal and a signal value of the sensing signal.

19. A method for driving a light emitting device of an image display, said method comprising:

receiving at said image display an image signal representing an image to be displayed; and controlling said light emitting device in accordance with a control signal based on a signal related to said image and a sensing signal indicating an operating state of said light emitting device, wherein the controlling the backlight subsystem comprises controlling the light emitting device according to the control signal without adjusting a pulse width of the periodic signal when the light emitting device operates within a normal range, and controlling the light emitting device by linearly changing the pulse width of the control signal in proportion to a size of the difference value between the normal range and out of the normal range when the light emitting device operates out of the normal range.

20. The method of claim 19, wherein said signal related to said image is a periodic signal.

21. The method of claim 20, further comprising detecting a period by detecting an edge of the periodic signal, and outputting a period value for use in said controlling step.

22. The method of claim 21, wherein the generating said result value comprises outputting a result value stored in a lookup table LUT according to a size of said sensing signal.

23. The method of claim 22, wherein the generating of the result value comprises:

comparing a signal value size of the sensing signal with a preset value and outputting a comparison result; and storing result values matched to comparison results, and outputting a different result value according to the comparison result of the comparator.

24. The method of claim 19, further comprising the step of generating a result value corresponding to a difference between the value of said sensing signal and a desired operating state of said light emitting device, and using said result value in the generation of said control signal.

25. The method of claim 24, wherein said control signal is generated using a product of said result value and a value of a periodic signal.

26. The method of claim 25, wherein, when a turn-on interval of the periodic signal exceeds a limit value corresponding to said product, the controlling comprises generating said control signal with a low state during a period of time having a duration corresponding to a portion of said turn-on interval of said periodic signal that exceeds said limit value.

27. The method of claim 24, wherein said controlling comprises receiving said sensing signal in response to said control signal, for use in generating said result value.

* * * * *